US005201259A

United States Patent [19]

Covert et al.

[11] Patent Number: 5,201,259

[45] Date of Patent: * Apr. 13, 1993

[54] FOOD PROCESSING APPARATUS

[75] Inventors: Darrell L. Covert, West Linn; Gary D. Cuddeford, Tigard; Kenneth J. Stanley, Aloha; John C. Julian, Tualatin, all of Oreg.

[73] Assignee: Lamb-Weston, Inc., Tri-Cities, Wash.

[ * ] Notice: The portion of the term of this patent subsequent to Dec. 25, 2007 has been disclaimed.

[21] Appl. No.: 611,184

[22] Filed: Nov. 9, 1990

Related U.S. Application Data

[62] Division of Ser. No. 119,662, Nov. 12, 1987, Pat. No. 4,979,418.

[51] Int. Cl.[5] ..... B26D 3/08

[52] U.S. Cl. ..... 83/865; 83/422; 83/423; 83/592; 83/672; 83/698; 83/932

[58] Field of Search ..... 99/538, 539, 540, 544, 99/545; 83/865, 862, 402, 409, 422, 423, 436, 932, 672, 698, 356.3, 592

[56] References Cited

U.S. PATENT DOCUMENTS 97,047 11/1869 Chrysler .
101,520 4/1870 Schaub .

(List continued on next page.)

FOREIGN PATENT DOCUMENTS 904795 9/1986 Belgium .
680486 2/1964 Canada .
0059075 9/1982 European Pat. Off. .
0136628 4/1985 European Pat. Off. .
1554003 1/1969 France .
8803007 7/1990 Netherlands .
333015 8/1930 United Kingdom .
599039 4/1948 United Kingdom .
986796 3/1965 United Kingdom .

OTHER PUBLICATIONS

Lamb-Weston, Inc. v. McCain Foods, Inc., C.V. No. 91-101-DA, Opinion and Order (Jul. 3, 1991).
Lamb-Weston, Inc. v. McCain Foods, Inc., C.V. No. 91-101-DA, Opinion and Order (Aug. 23, 1991).
Lamb-Weston, Inc. v. McCain Foods, Inc., C.V. No. 91-101-DA, Opinion (Jan. 9, 1992).
Lamb-Weston, Inc. v. McCain Foods, Inc., C.V. No. 91-101-DA, Deposition Transcript of Kerwin Dow (Oct. 4, 1991).
Lamb-Weston, Inc. v. McCain Foods, Inc., Appeal No. 91-35476, Opinion (Aug. 12, 1991).

*Primary Examiner*—Frank T. Yost
*Assistant Examiner*—Rinaldi Rada
*Attorney, Agent, or Firm*—Klarquist, Sparkman, Campbell, Leigh & Whinston

[57] ABSTRACT

A method and apparatus are disclosed for efficiently cutting food items, such as potatoes, into helical strips. The food items are provided seriatim to the cutting assembly from a conveyor system fed by a trough shaker or other singulator device. Food items on the conveyor are aligned longitudinally and are then impaled on small spikes protruding from the conveyor so that they maintain the longitudinal orientation during their travel to a feed roller portion of the system. The feed rollers firmly grip the food items by their peripheries and advance them into the rotary cutting assembly. This assembly includes a helically shaped cutting member defining at a leading edge thereof a slicing blade and supporting on its front surface a plurality of perpendicularly extending scoring blades. The helically shaped cutting member is mounted at its periphery by being threadedly received in a helical thread cut in an annular holder. This holder, in turn, is affixed to a toothed drive ring which is rotatably mounted in a cutting assembly housing. This composite assembly is removably mounted in the apparatus and the toothed drive ring driven by a drive gear that extends through an opening in the housing. The apparatus cuts food items quickly and efficiently and includes features designed to minimize cutting stresses that may impair the structural integrity of the resulting products.

21 Claims, 5 Drawing Sheets

U.S. PATENT DOCUMENTS

| | | | |
|---|---|---|---|
| 497,675 | 5/1893 | Miller . | |
| 782,292 | 2/1905 | Walter . | |
| 1,094,604 | 4/1914 | Shibata . | |
| 1,212,915 | 1/1917 | Daughtry . | |
| 1,361,776 | 12/1920 | Rosenfeld . | |
| 1,534,078 | 4/1925 | Ruffner . | |
| 1,970,997 | 8/1934 | Dorman | 83/62 |
| 1,995,048 | 3/1935 | Walter | 146/95 |
| 2,017,559 | 10/1935 | Wolfinger . | |
| 2,036,012 | 3/1936 | Bellinghausen | 83/422 X |
| 2,156,645 | 5/1939 | Waller . | |
| 2,178,920 | 11/1939 | Savery | 146/219 |
| 2,464,993 | 3/1949 | Ross . | |
| 2,489,581 | 11/1949 | Mason . | |
| 2,508,868 | 5/1950 | Ross . | |
| 2,519,985 | 8/1950 | Thompson | 146/124 |
| 2,610,664 | 9/1952 | Thompson . | |
| 2,652,871 | 9/1953 | Botley et al. . | |
| 2,722,256 | 11/1955 | Hise . | |
| 2,787,273 | 4/1957 | Kerr . | |
| 2,826,229 | 3/1958 | Necula . | |
| 3,057,386 | 10/1962 | Massaro . | |
| 3,109,468 | 11/1963 | Lamb et al. . | |
| 3,153,436 | 10/1964 | Chesley . | |
| 3,175,561 | 3/1965 | Oldershaw . | |
| 3,211,202 | 10/1965 | Mason . | |
| 3,217,768 | 11/1965 | Lamb . | |
| 3,318,351 | 5/1967 | Werder . | |
| 3,653,418 | 4/1972 | Oldershaw . | |
| 3,799,023 | 3/1974 | Brignard et al. | 83/663 |
| 3,874,259 | 4/1975 | Chambos et al. | 83/408 |
| 3,881,406 | 5/1975 | Perez | 99/594 |
| 3,952,621 | 4/1976 | Chambos | 83/733 |
| 4,050,339 | 9/1977 | Soleri | 83/703 |
| 4,073,060 | 2/1978 | Hendricks | 30/279 |
| 4,135,002 | 1/1979 | Hodges et al. | 426/482 |
| 4,137,839 | 2/1979 | Couture et al. | 99/541 |
| 4,170,174 | 10/1979 | Ditty et al. | 99/538 |
| 4,190,208 | 2/1980 | Schaeffer et al. | 241/92 |
| 4,198,887 | 4/1980 | Williams, Jr. | 83/356.3 |
| 4,216,689 | 8/1980 | Suhling | 83/77 |
| 4,228,963 | 10/1980 | Yamauchi et al. | 241/92 |
| 4,329,900 | 5/1982 | Dennis et al. | 83/422 X |
| 4,367,667 | 1/1983 | Shibata | 83/356.3 |
| 4,368,657 | 1/1983 | Pellaton | 83/356.3 |
| 4,387,111 | 6/1983 | Müllender | 426/615 |
| 4,393,737 | 7/1983 | Shibata | 83/356.3 |
| 4,395,942 | 8/1983 | Thompson | 99/538 X |
| 4,538,491 | 9/1985 | Henneuse | 83/402 |
| 4,560,111 | 12/1985 | Cavalli | 241/92 |
| 4,614,141 | 9/1986 | Mendenhall et al. | 83/402 |
| 4,644,838 | 2/1987 | Samson et al. | 83/865 |
| 4,656,909 | 4/1987 | Carter et al. | 83/874 |
| 4,704,959 | 11/1987 | Scallen | 99/538 |
| 4,852,441 | 8/1989 | Anders et al. | 83/155 |
| 5,010,796 | 4/1991 | Mendenhall | 83/865 |

FOOD PROCESSING APPARATUS

This is a division of application Ser. No. 07/119,662, filed Nov. 12, 1987, now U.S. Pat. No. 4,979,418.

FIELD OF INVENTION

The present invention relates to food processing, and more particularly to a method and apparatus for cutting a food item, such as a potato, into helical strips.

BACKGROUND AND SUMMARY OF THE INVENTION

Helical french fries, or curlicue fries as they are more commonly known, have long been popular fare at carnivals, state fairs and restaurants. In addition to their engaging appearance to consumers, helical fries offer an important marketing benefit to their purveyors: good "plate coverage." Plate coverage refers to the apparent volume of food received by a customer for a given cost. Since a serving of curlicue fries inherently includes a large volume of air, it appears larger than a like weight of conventional french fries. For example, the plate coverage provided by four ounces of conventional fries may require only three ounces of helical fries. This differential can be translated into higher profit margins for the retailer or can be passed on as more generous servings to the consumers.

Apparatuses suitable for making strips for curlicue french fries have been known for decades. The prior art shows two general classes. In the first, the potato is rotated and brought into engagement with a non-rotating cutting element. U.S. Pat. No. 3,874,259 to Chambos illustrates such a system that employs an electric drill to rotate the potato. As a general proposition, this class of devices is poorly suited for use in large food processing operations due to the difficulty of repeatedly gripping, rotating and cutting large numbers of potatoes seriatim.

Better suited for large commercial applications is the second class of helical cutting devices. In this class, the cutting element is rotated and brought into engagement with a non-rotating potato. An exemplary apparatus is shown in French patent 1,554,003. The problem with many devices of this class, however, is that the means employed to hold the potato against rotation while it is being cut cannot rapidly be released to permit the processing of the next potato.

One proposed solution to this problem is shown in U.S. Pat. No. 4,644,838 to Samson et al. and involves the use of a plurality of spring loaded fingers which protrude through the wall of a feed chute supplying potatoes to the cutting element and which act to restrain the potatoes therein against rotation. A reciprocating plunger pushes potatoes through the chute. Such an arrangement, however, limits the speed with which the apparatus can process potatoes since approximately half of the plunger's motion is wasted. The plunger itself contributes to the complexity of this system since its periphery must be configured with grooves to permit the plunger to pass by the fingers in the chute without pushing the fingers to their retracted positions.

The present invention overcomes the above noted drawbacks of the prior art and provides a simply apparatus for processing large numbers of potatoes into helical strips quickly and efficiently. The invention overcomes the problem of holding the potato against rotation by adopting a means known to certain fields of the food processing art but never before applied to the production of helical fries, namely feed roller. Such feed rollers comprise pairs of counter-rotating shafts with engagement spurs or paddles thereon for passing elongated food items along an axis extending therebetween. These devices are used, for example, in the SC-120 Corn Cutter marketed by FMC Corp. to feed cob corn to a cutting assembly. The FMC device is described in detail in U.S. Pat. No. 2,787,273.

In the apparatus of the invention, potatoes are provided to the feed rollers from a conveyor which is supplied with potatoes at its intake end from a trough shaker or other singulator device. Potatoes on the conveyor are aligned longitudinally and are then impaled on small spikes protruding from the conveyor so that they maintain that orientation during their travel to the feed roller portion of the system. The feed rollers firmly grip the potatoes by their peripheries and advance them into the rotary cutting assembly. This assembly comprises a helically shaped cutting member defining a slicing blade at a leading edge thereof and supporting a plurality of perpendicularly extending scoring blades on its front surface. The helically shaped cutting member is mounted at its periphery by being threadedly received in a helical thread cut in an annular holder. This holder, in turn is affixed to a toothed drive ring which is rotatably mounted in a cutting assembly housing. This composite assembly is removably mounted in the apparatus and the toothed drive ring driven by a drive gear that extends through an opening in the housing. The apparatus includes features designed to minimize stresses in the cutting of the potatoes that may impair the structural integrity of the resulting helical strips.

These and other objects, features and advantages of the present invention will be more readily apparent from the following detailed description, which proceeds with reference to the accompanying drawings.

DETAILED DESCRIPTION OF THE ILLUSTRATED EMBODIMENT

The apparatus of the invention is adaptable for cutting various bulbous vegetables into helical strips. The illustrated apparatus is particularly adapted to the cutting of potatoes into helical strips and the apparatus will be described as it is applied to the cutting of potatoes and particularly to potatoes such as the Russett Burbank variety having a long axis and an elliptical cross section.

Figure 1:
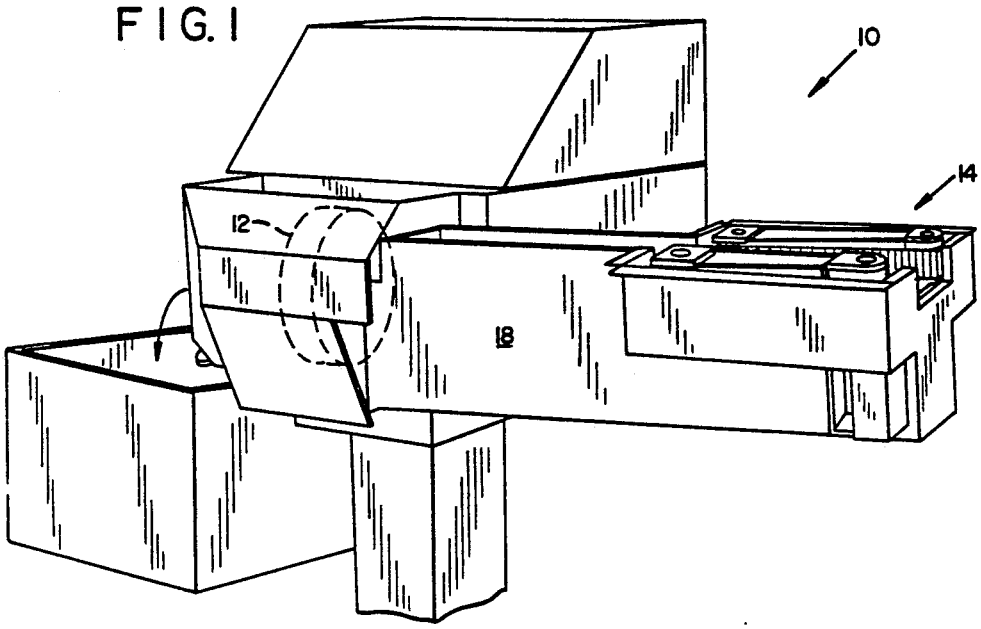
FIG. 1 is a perspective view of a food processing apparatus according to an illustrated embodiment of the present invention.
Figure 2:
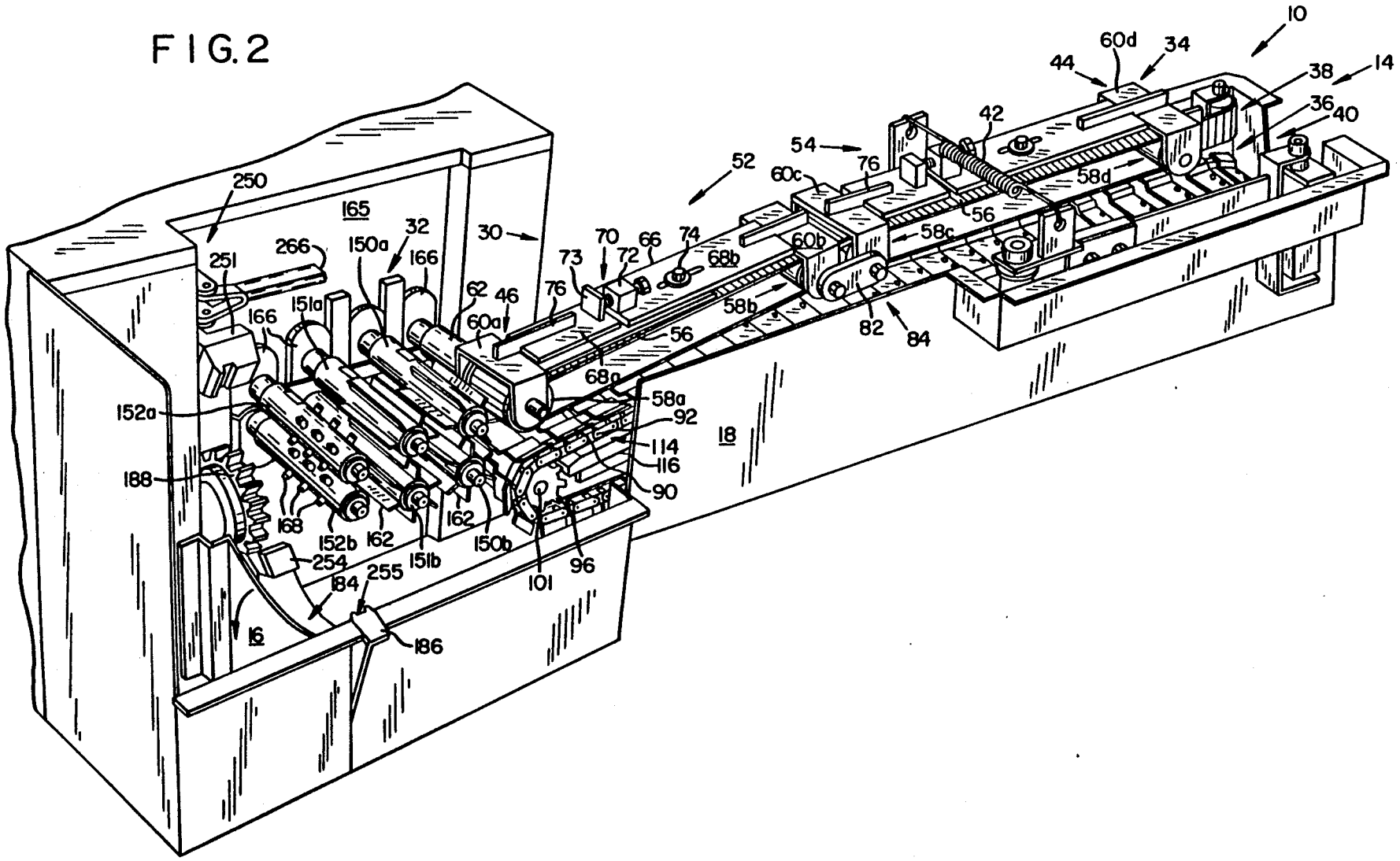
FIG. 2 is an enlarged fragmentary perspective view of the apparatus of FIG. 1 with the cutting assembly removed.
Figure 3:
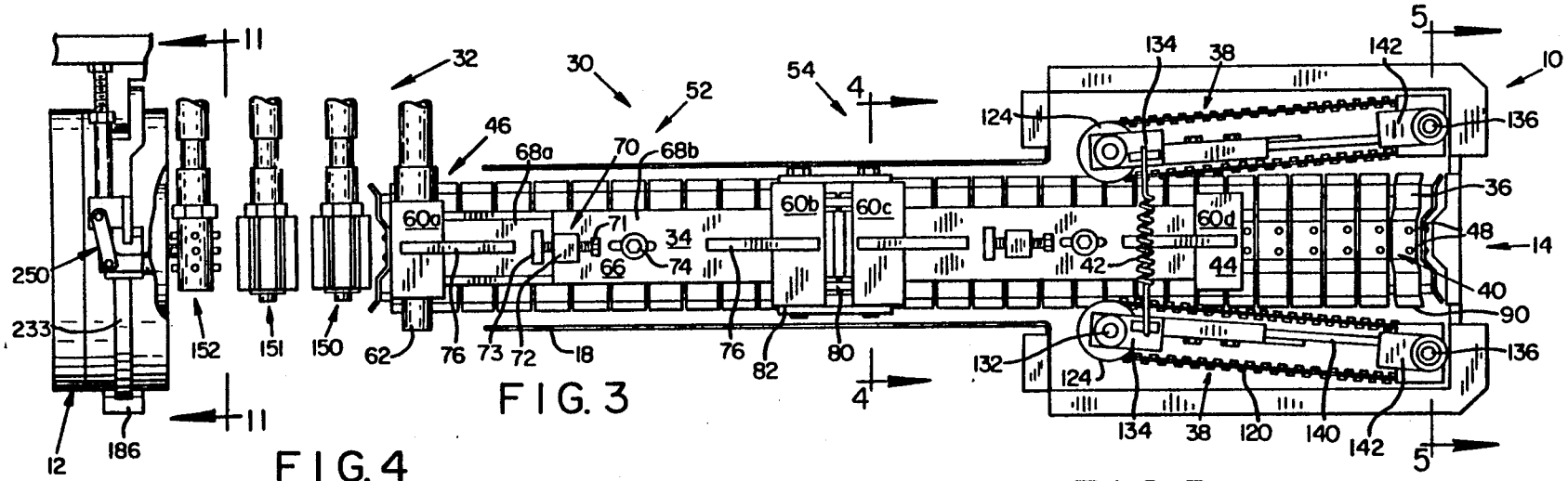
FIG. 3 is a fragmentary top plan view of the apparatus of FIG. 2.

With reference to FIGS. 1 and 2, a food processing apparatus 10 according to the illustrated embodiment of the invention comprises a rotary cutting assembly 12 into which potatoes are fed by a feed system 14. The potatoes are provided one by one to the feed system 14 from a conventional trough shaker or other singulator device (not shown) capable of feeding potatoes one by one in slightly spaced relation. Helical potato strips cut by the rotary cutting assembly 12 fall into a collection bin 16. The entire apparatus is enclosed in a stainless steel housing 18 for safety.

Referring more particularly to FIGS. 2–5, feed system 14 includes two principle sections: a conveyor section 30 and a feed roller section 32. Conveyor section 30 includes top, bottom and opposite side conveyors 34, 36 and 38, respectively. Potatoes provided to feed system 14 are initially placed on bottom conveyor 36 at an entry position 40, between side conveyors 38. The side conveyors 38 are biased toward each other at their discharge ends by a spring 42 (FIG. 2) and act to center the potato on the lower conveyor 36. Soon after a potato is positioned at entry position 40, it is carried beneath a first or forward end 44 of the top conveyor 34.

The top conveyor 34 is pivotally mounted at its second or discharge end 46 so that the forward end 44 can rise and allow potatoes of various sizes to pass thereunder. The weight of top conveyor 34 on the entering potatoes causes the potatoes to become impaled on dogs 48 spaced periodically along the lower conveyor's length. The top conveyor 34 includes two hingedly connected sections 52, 54. The section 52 comprises a rubber belt 56 lugged on its outer surface and trained over a pair of rollers 58*a* and 58*b*. Roller 58*a* is mounted on a drive shaft 62 to which a yoke 60*a* is pivotally mounted. Roller 58*b* is rotatably mounted in a second yoke 60*b*. The yokes 60*a*, 60*b* are mounted to the opposite ends of an expandable frame 66 which permits tensioning of belt 56. The expandable frame 66 comprises two slidably engaging members 68*a*, 68*b* linked together by a tensioning device 70 comprising a bolt 71 threaded through a mount 72 on the frame member 68*b* and engaging a stop 73 on the frame member 68*a*. When the bolt 71 is extended out of the mount 72 toward the stop 73, the frame 66 is extended. A locking bolt 74 is provided to lock the members 68*a*, 68*b* in position. Ribs 76 extend from yokes 60 along the frame members 68*a*, 68*b* to improve the structural rigidity thereof.

The second section of top conveyor section 54 is similar in construction to the first section 52 and comprises a belt 56 trained over rollers 58*c*, 58*d* mounted in yokes 60*c*, 60*d*, respectively, which are mounted to the opposite ends of an expandable frame 66. The first and second conveyor sections 52, 54 are tied together by oppositely positioned tie straps 82 in which the shafts for the rollers 58*b*, 58*c* are journaled. The tie straps 82 cooperate with yokes 60*b*, 60*c* to form an articulated joint 84 that allows first section 54 of top conveyor 34 to move substantially independently of second section 52 and facilitates vertical movement of the top conveyor to accommodate passage of potatoes thereunder. The second section 54 is driven from first section 52 by two drive belts 80 trained over the rollers 58*b* of section 52 and 58*c* of section 54, the ends of the rollers being provided with grooves to receive the belts 80 (see FIG. 4).

The bottom conveyor 36 (FIGS. 2–5) comprises a plurality of metal pans 90 linked pivotally to one another and welded at each side to links of one of a pair of drive chains 92. Each pan 90 is provided with an upstanding flange 94 along each side edge to prevent a potato from bouncing out of the pan as it is fed therein. Adjacent the flanges 94 are opposite flat portions, the center of a pan having a center trough depression 95 defined by sloping side walls 97 and a flat bottom 98 which carries the dogs 48. The potatoes will tend to be carried lengthwise in the trough 95 as indicated in FIG. 5 wherein a potato 99 is shown in dotted lines.

Figure 5:
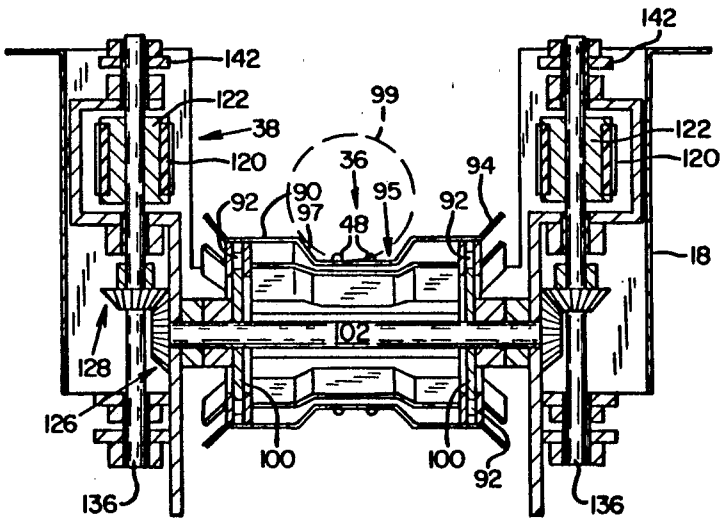
FIG. 5 is an enlarged sectional view taken on line 5—5 of FIG. 3.
Figure 4:
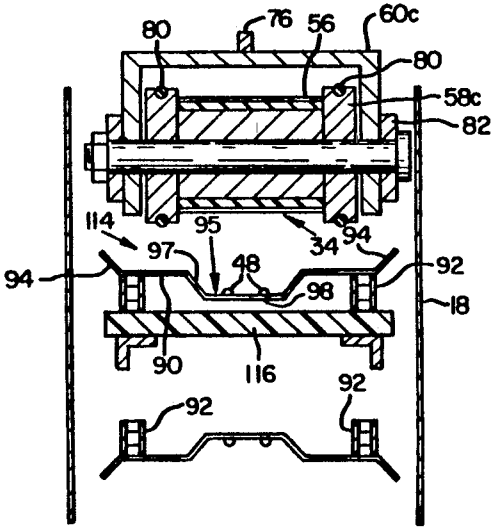
FIG. 4 is an enlarged sectional view taken on line 4—4 of FIG. 3 showing a portion of the conveyor section of the feed assembly.

The drive chains 92 are driven by drive sprockets 96 mounted on a drive shaft 101 and are carried by sprockets 100 on a distal shaft 102 at the infeed end of the conveyor (see FIG. 5). The drive shafts 62, 101 for the upper and lower conveyors 34, 36 are mounted and driven by an arrangement similar to the mounting shafts 70 of the Green Corn Cutting Machine shown in U.S. Pat. No. 2,787,273, which arrangement permits their movement toward and away from one another to accommodate the passage of potatoes therebetween. A support member 116 formed of low friction plastic is disposed beneath the upper run 114 of the conveyor 36 for substantially its entire length to prevent the conveyor from deforming under the combined weight of potatoes and the upper conveyor.

The side conveyors 38 are positioned adjacent the entrance end of the conveyor section 30 to assure centering of the potatoes on the lower conveyor 36 as they are fed from the trough shaker onto the conveyor section. The side conveyors 38 are similar and each comprises a rubber belt 120 lugged on both surfaces and carried by correspondingly lugged rollers 122, 124. The rollers 122 are fixed to vertical shafts 136 and driven through pinion gears 126, 128 from the shaft 102 which is driven by the bottom conveyor 36 (see FIG. 5). The rollers 124 are rotatably mounted on shafts 132 carried by yokes 134 supported on the free end of the internal frame 140, the opposite end of which is fixed to yokes 142 pivotally mounted on the respective drive shaft 136. The side conveyors 38 are urged toward one another by a tension spring 42 connected to yokes 134.

Figure 10:
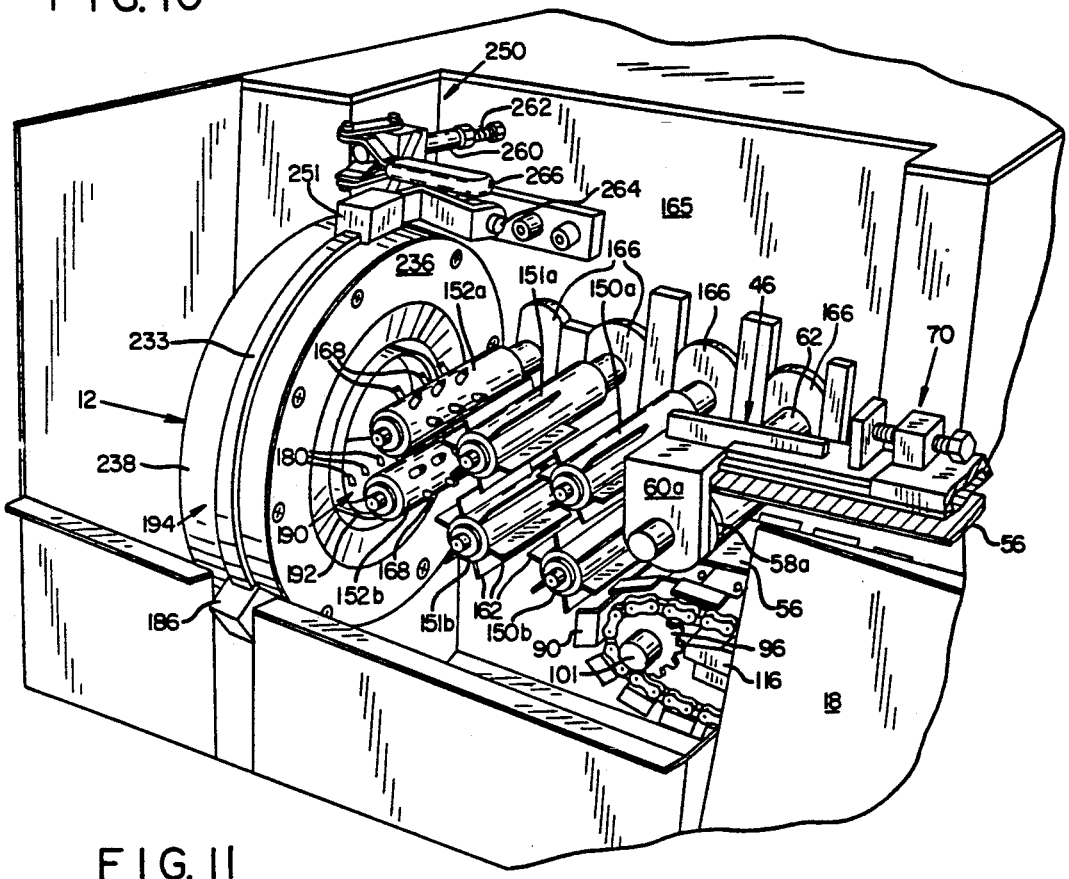
FIG. 10 is an enlarged fragmentary perspective view of the apparatus of FIG. 1 showing the rotary cutting assembly mounting arrangement and the relationship between the rotary cutting assembly and the feed rollers.

As a potato leaves the conveyor section 30, it passes between three pairs of feed rollers 150, 151, 152 (FIGS. 2, 3 and 10) that advance the potato into the rotary cutting assembly 12 while preventing it from rotating. These rollers are mounted and driven in a manner similar to that shown in U.S. Pat. No. 2,787,273 for the feed rollers 60, 62, 64 thereof. Thus, the upper and lower feed rollers of each pair 150, 151 and 152 are secured to upper and lower shafts 153 and 155, respectively (FIG. 11), there being one such pair of shafts for each pair of rollers. Each shaft 153 and 155 is connected through a universal joint 156 to a worm gear 157 which is enmeshed with a driving worm 158 on a main driving shaft 159. One such driving worm is provided for each pair of shafts 153 and 155, the worm gears 157 of which engage the driving worm at opposite sides so that the two shafts 153, 155 of each pair rotate in opposite directions. Hence, the feed rollers 150, 151 and 152 cooperate with each other to advance the potatoes successively from the conveyor section 30 to the rotary cutting assembly 12.

Each of the three pairs of feed rollers 150, 151 and 152 is provided with means for resiliently pressing the respectively associated upper and lower rollers toward each other. Each pair of rollers is likewise provided with means interconnecting the associated upper and lower rollers for assuring equalized, opposite movement. Since these means employed for each pair of rollers are identical with those employed for each of the other pairs, a description of the pressing means and the equalizing means for one pair of rollers will suffice. For example, the shafts 153 and 155 of the third pair of feed rollers 152 (FIG. 11) are rotatable in upper and lower bearing blocks 160 and 161 respectively, which are guided and restricted to vertical sliding movement in channels 163 and 164 in a housing 165. Debris seals 166 slide with shafts 153, 155 and prevent debris from entering the roller positioning mechanism inside the housing 165. Upper and lower equalizing arms 167 and 169 are pivoted, respectively, on shafts 171 and 173 which are rigidly mounted on a frame 175. The outer ends of the arms 167 and 169 bear against the bearing blocks 160 and 161 toward each other by force derived from biasing springs 176 and 177. The biasing springs 176, 177 encircle a tensioning rod 178 and are each compressed between one of the equalizing arms and a nut 179 on the associated end portion of the rod. Accordingly, the springs 176 and 177 continuously urge the feed rollers **152*a*, 152*b*** toward each other to effect engagement of the same with a potato with pressure adequate to ensure advance of the potato in response to rotation of the rollers and to prevent the potato from rotating.

The mechanism that interconnects the feed rollers **152*a* and 152*b* for equalized movement in opposite directions includes arms 181 and 183 extending toward each other from the upper and lower shafts 153 and 155, respectively. These two arms 181 and 183 are interengaged by a tooth and notch arrangement 185 whereby rotary motion of the one about the axis of its supporting shaft effects simultaneous and corresponding rotary motion of the other about the axis of its supporting shaft. Whereas the lower arm 183 is integral with the lower equalizing arm 169, the upper arm 181 is mounted pivotally on the shaft 171 independently of the upper equalizing arm and is adjustably connected thereto by a lever 187. The lever 187 is integral with the arm 181 and extends upwardly from the shaft 171 where it is engaged between opposed adjusting screws 189 carried by a lever 191 integral with the upper equalizing arm 167. By manipulation of the adjusting screws 189, the angular position of the upper equalizing arm relative to the lever 191 can be adjusted, and consequently the two feed rollers 152*a*, 152*b*** can be adjusted to positions wherein they are equidistant from the horizontal axis of rotation of the cutting element.

In view of the fact that all of the upper feed rollers **150*a*, 151*a* and 152*a* are rotated in one direction while all of the lower feed rollers 150*b*, 151*b* and 152*b* are rotated in the opposite direction, a potato delivered to the first pair of rollers 150 will be advanced thereby to the second pair 151, which will pass the potato to the third pair of rollers 152, which in turn will advance the potato into the rotary cutting assembly 12**.

Since the equalizer arms 167 and 169 associated with each pair of feed rollers are interconnected as above described, the rollers of each pair will be thrust apart by each potato as the potato enters between the two opposed rollers, the amount of such yielding movement depending upon the diameter of the potato. Furthermore, the opposite rollers of each pair will always be disposed at equal distances above and below the axis of rotation of the rotary cutting element so that each potato during its travel through the machine is maintained in coaxial alignment with the rotary cutting assembly 12.

The feed rollers 150 and 151 are provided with metal fins or paddles 162 (FIG. 10) which positively engage a potato without damaging its exterior. The feed rollers 152 immediately adjacent rotary cutting assembly 12, however, are provided with pins 168 which more positively engage the surface of a potato to prevent its rotation after it is engaged with the cutting assembly and more positively feed the potato into the cutter knife. Since the spiked rollers 152 provide the last positive control over the potato as it enters the rotary cutting assembly 12, it is desirable that these rollers be as close to this cutting assembly as possible (a spacing of 0.75 inches has been found satisfactory) and that the rollers be able to grip even the small butt end of a potato. To this end, bearing blocks 160 and 161 for upper and lower shafts 153 and 155 are sized so that the nominal distance between rollers 152 is smaller than the distance separating the other pairs of rollers 150 and 151. This permits the rollers 152 to exert good control over a potato even when gripped from at its butt end.

Figure 6:
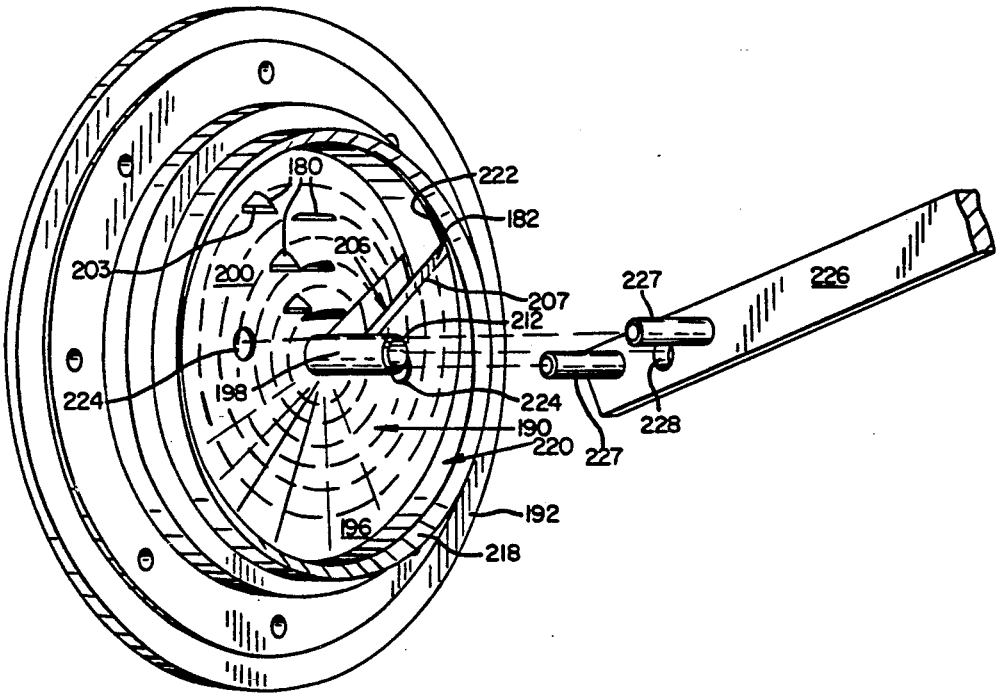
FIG. 6 is a perspective exploded view of a cutting element and associated holder used in the apparatus of the invention and a tool for inserting and removing the cutter from the holder.

The rotary cutting assembly 12 cuts the potatoes advanced through it into helical strips by action of a plurality of concentrically spaced scoring blades or knives 180 and a slicing blade 182 (FIG. 6). Rotary cutting assembly 12 rests in a cradle 184 defined by a guide 186 (compare FIGS. 2 and 10) and is driven by a drive gear 188 powered by an electric motor (not shown).

Referring now to FIGS. 6–9, the rotary cutting assembly 12 includes a cutting element 190, a ring-like holder 192 for mounting the cutting element at its periphery and a housing 194 within which the holder/cutting element combination can rotate. Cutting element 190 principally comprises a helically shaped plate 196 welded about a central tube 198. On a front surface 200 of the plate 196 are welded the scoring knives or blades 180 which are spaced apart radially from the central tube 198 and extend substantially parallel thereto for concentrically scoring a potato as it is advanced towards the front surface. The blades 180 are desirably disposed on the plate 196 in an alternating, staggered arrangement defining at least two radially extending rows. This arrangement minimizes frictional engagement between the potato and the blades by reducing the compression of the potato in the regions being cut. The blades 180 are bevelled on their outer sides 202 (FIG. 7) to form cutting edges 203 on their outer leading edges, the compression stress induced in the potato by the penetration of the blades 180 being relieved by expansion of the potato towards its periphery.

The plate 196 has a leading edge portion 204 (FIG. 6) defining the radially extending slicing blade 182 that slices the face of a potato scored by the scoring blades 180. The leading edge portion 204 is bent or inclined approximately three degrees relative to the projected surface of the plate 196 in a direction away from its trailing edge 205 (that is, in the direction towards an advancing potato) for a width of about 0.3 inches, as shown by the bend line 207 in FIG. 7. This arrangement has been found to aid in drawing the potato into and through the cutting assembly. The slicing blade 206 is bevelled on its rear surface 208 opposite front surface 200 to form a knife edge 209 to enhance this effect (see FIG. 8).

The central tube 198 (FIG. 9) terminates in a plane perpendicular to its axis and is bevelled at a front end 210 thereof to define a cutting edge 212 along its inner periphery. The cutting edge 212 cuts cores from potatoes advancing into the rotary cutting assembly 12, which cores then pass through tube 198 to the collection bin 16 (FIG. 2). The front end 210 of tube 198 is desirably swaged in so that the cutting edge 212 defines a cutting diameter less than the nominal inside diameter of the tube 198 so the cores cut by the cutting edge may more easily slide through the tube to the collection bin.

Figure 9:
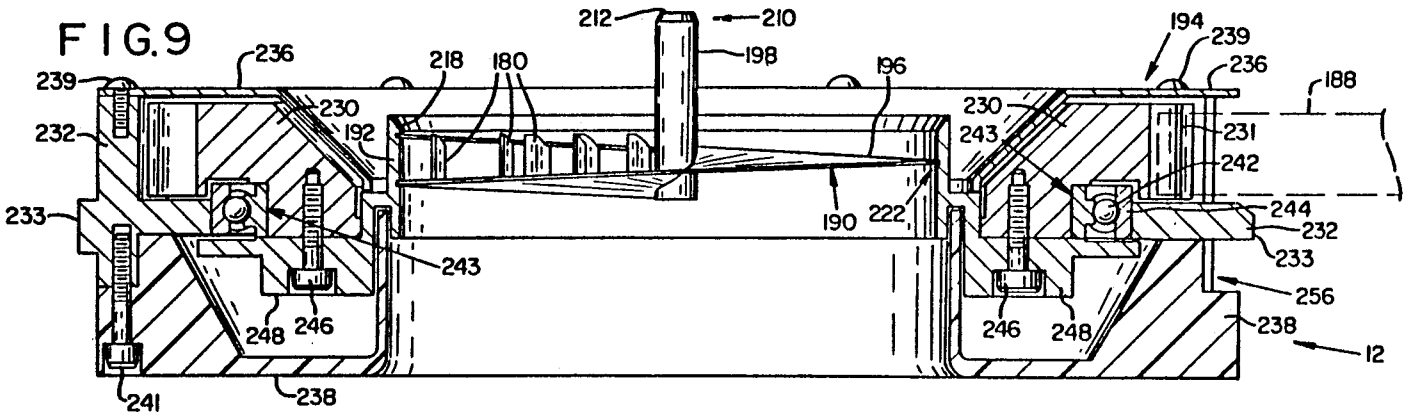
FIG. 9 is a sectional view of a rotary cutting assembly used in the apparatus of the invention.
Figure 7:
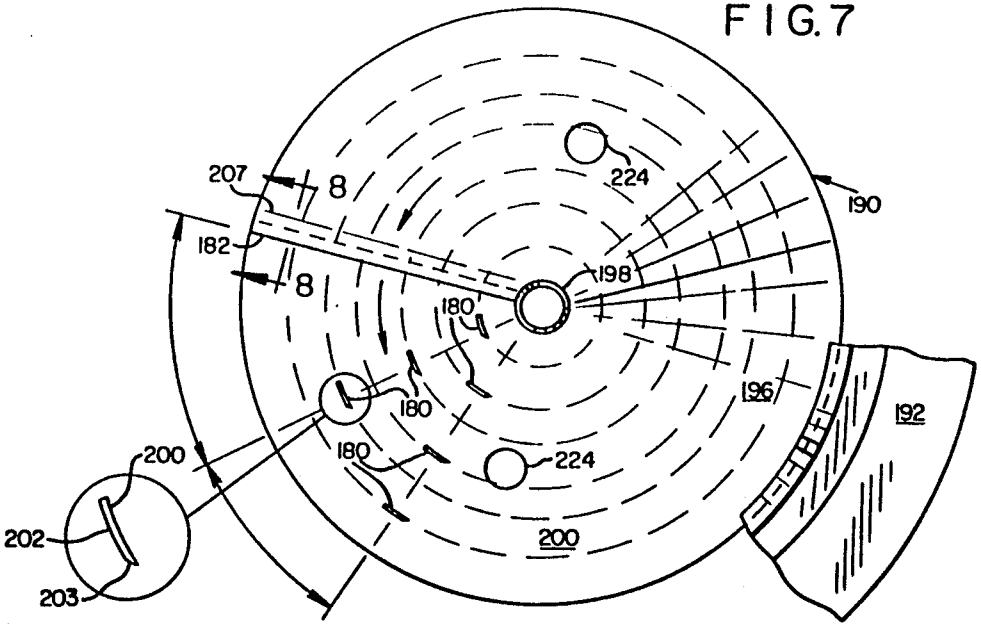
FIG. 7 is a plan view of the cutting element of FIG. 6 showing in dashed lines the concentric paths of the scoring knives and showing a fragmentary portion of the holder for the cutting element.
Figure 8:
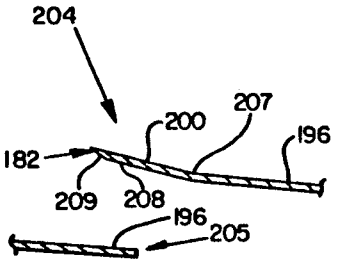
FIG. 8 is a sectional view taken on line 8—8 of FIG. 7 showing the inclined slicing edge portion of the cutting element.

Referring now to FIGS. 6 and 9, the leading edge of the cutting element holder 192 is formed with a bevel 218. The inner peripheral surface 220 of the holder 192 is formed with a helical groove 222 that begins at the bevel 218 and which corresponds to the pitch of the helical plate 196 at its periphery so that the plate can be threadedly received by the holder 192. The threading of plate 196 into and out of the holder 192 is facilitated by providing at least one hole 224 in the plate spaced radially from its center. A tool 226 having a suitable projecting pin 227 and a hole 228, such as are shown in FIG. 6, can then be engaged in hole 224 and with the hole in tube 198 to enable application of a torque to the plate 196 by which it can be threaded into or out of the holder 190. The groove 222 into which the helical plate 196 threads is just slightly longer than one full turn so that the plate 196, when fully threaded in, is locked against further rotation relative to the holder.

The holder 192 and the cutting element 190 are rotatably mounted in the rotary cutting assembly 12 (FIG. 9) which includes a housing 194 including a front guard portion 236 and a rear guard portion 238 between which is mounted a frame ring 232 by screws 239, 241.

The housing 194 is fixedly mounted in the apparatus by means to be described while the holder and cutting element 190 rotate relative thereto. Secured to an outer flange 248 of the holder 192 by screws 246 is a drive ring 230 having gear teeth 231 formed on the periphery thereof. The ring 230 is provided with a circumferential groove 243 for receiving a sealed circular bearing 242, the outer race 244 of which engages the frame ring 232. The bearing 242 thus permits relative rotational movement between the drive ring 230 and the frame ring 232. The toothed drive ring 230 is rotatably driven by the drive gear 188 (FIGS. 2, 11) when the rotary cutting assembly 12 is positioned in the cradle 184. The rotational movement of the drive ring 23 is transmitted to the holder 192, and thus to the cutting element 190. The frame ring has a peripheral protrusion 233 thereon, the function of which will be described.

Figure 11:
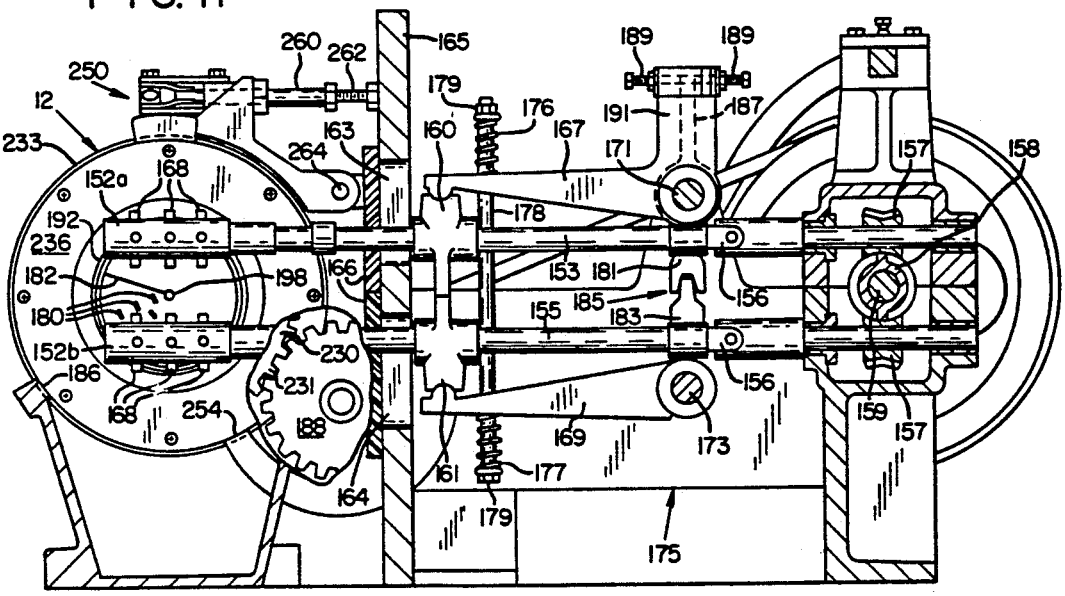
FIG. 11 is an enlarged fragmentary sectional view of the apparatus taken on line 11—11 of FIG. 3 illustrating the feed roller mechanism.

The rotary cutting assembly 12 is releasably secured to the frame of the apparatus 10 by an overcenter clamp assembly 250 (FIG. 10) abuts the housing 165 and which engages notched block 251 with the peripheral protrusion 233 on the frame ring 233. When in the position illustrated, a post 260 extends from clamp 250 and abuts the housing 165 through a bolt 262, thereby urging the block 251 downwardly onto the assembly 12 about a pivot point 264. When a handle 266 of clamp 250 is pulled forwardly, post 260 is retracted from its abutment with the housing 165, permitting block 251 to swing upwardly about the pivot 264 to release assembly 12. The protrusion 233 on assembly 12 that is engaged by the notched block 251 of clamp 250 also keys into a notch 255 in the guide seat 186 (FIGS. 2 and 10) to assure proper alignment of the assembly in the apparatus. As shown in FIG. 11, the drive gear 188 meshes with the gear teeth 231 on the drive ring when the assembly 12 is mounted in place. An orienting boss 254 in the cradle 184 engages a notch 256 (FIG. 9) in the frame ring 232 to prevent rotation of assembly 12 when drive gear 188 is operated.

It is apparent from the foregoing description and drawings that cutting element 190 and holder 192 to which it is mounted are held in place or cradled such that they are permitted to rotate about their coincident longitudinal axes but otherwise are constrained from moving radially or axially. It will also be apparent from the foregoing, particularly with reference to FIG. 9, that the above-referenced helical disk or plate 196 has a uniform spacing or gap between its leading edge and trailing edge such that the leading edge and trailing edge are parallel to one another.

In operation, the trough shaker or other singulator feeding food processing apparatus 10 provides potatoes to entry position 40 with their long axes aligned parallel to the top and bottom conveyors 34, 36. Preferably, the potatoes are provided seriatim, but at a rate slightly less than the advance rate of the conveyors so that they are spaced apart by a slight distance after they have been engaged by the conveyors. The orientation and spacing of the potatoes is maintained during their travel by the conveyors' and feed rollers' positive engagement mechanisms.

The peripheral speed of the feed rollers 150–152 is desirably slightly greater than the apparent advancing speed of the slicing blade 182. If the pitch of the slicing blade, or the speed at which it is rotated, is such that the advancing rate of the slicing blade 182 is faster than the advancing rate of the potato, a severe stress is introduced into the potato at the point at which it is being cut. This stress can break the resultant helical strips into non-continuous segments. This is avoided by the desired arrangement in that a potato will be firmly urged against the rotating cutting element 196, with the speed differential causing the potato to slip slightly on the spikes 168 on the feed rollers 152. The spacing between adjacent potatoes in the feed system permits this "overfeeding" of potatoes into the cutting element without resulting in a backing up of the incoming potatoes.

Having described and illustrated the principles of our invention in an illustrated embodiment, it should be apparent to those skilled in the art that the invention can be modified in arrangement and detail without departing from such principles. Accordingly, we claim all modifications coming within the scope and spirit of the following claims.

We claim:

1. An apparatus for slicing food items into helical strips comprising:

a helical disk-like cutter element adapted to slice food items into helical strips through unidirectional rotation, and having a longitudinal axis, a front surface, an inner edge and an outer periphery;

the cutter element having a radially extending leading slicing edge and a trailing edge, the slicing edge being substantially flush with the cutter element;

a plurality of scoring blades mounted on the front surface and extending substantially perpendicularly away therefrom for concentrically scoring the food item before the item is sliced by the slicing edge; and a feed structure for advancing the food items one at a time to the cutter element.

2. The apparatus of claim 1 further including mounting means for mounting and dismounting the cutter element through rotation of the cutter element about the longitudinal axis, the mounting means including thread means for cooperatively engaging and supporting the outer periphery of the cutter element.

3. The cutting assembly of claim 2 wherein the mounting means includes a substantially cylindrical holder, and further including drive means cooperative with the holder for rotating the holder through a gearing arrangement.

4. The apparatus of claim 2 wherein the feed structure includes at least two feed rollers for advancing without rotation an item of food with core intact towards the cutter element such that longitudinal axes of the food item and cutter element are aligned with one another, the apparatus further including means cooperative with a peripheral portion of the cutter element for rotating the cutter element.

5. An apparatus for slicing food items into helical strips comprising:

a helical disk-like support member of substantially uniform pitch having disposed thereon and extending substantially perpendicularly away therefrom a plurality of scoring blades, the support member having a substantially radially extending cutting edge and a longitudinal center axis of rotation, the cutting edge being substantially flush with the support member, the scoring blades being spaced varying radial distances from the center axis;

a feed structure for automatically feeding food items in a singulated manner to the support member for slicing; and means for mounting the support member such that the support member is capable of rotation about the axis of rotation but is constrained from moving radially and longitudinally.

6. An apparatus for slicing food items into helical strips comprising:

a helical disk-like cutter element of substantially uniform pitch having disposed thereon and extending substantially perpendicularly away therefrom a plurality of scoring blades, and having a substantially radially extending cutting edge, the support member having a longitudinal center axis which also serves as an axis of rotation, the scoring blades being spaced varying radial distances from the center axis;

a feed structure for automatically feeding food items in a singulated manner to the cutter element for slicing; and a mounting structure for mounting the cutter element such that the cutter element is capable of rotating about the axis of rotation but otherwise is constrained from moving in any direction.

7. A cutting assembly for a food processing apparatus including:

a central member;

a disk-like support member having an inner edge, an outer periphery and a radially extending cutting edge, the inner edge abutting the central member; and a mounting member for supportively engaging the support member, the mounting member having a portion thereof which includes thread means for threadably receiving the outer periphery of the support member so as to permit the support member to be attached to and detached from the mounting member by threading the support member into and out of the thread means, the support member defining a continuous surface extending from the outer periphery to the inner edge.

8. The assembly of claim 7 in which the support member includes a helicoidal blade.

9. A food processing apparatus comprising:

a helical disk-like support member of substantially uniform pitch, the support member having a front surface towards which a food item is to be advanced and having a slicing blade at a substantially radially extending edge thereof, the support member having an outer periphery;

a plurality of scoring blades mounted on the front surface and extending substantially perpendicularly away therefrom for scoring the food item before the item is sliced by the slicing blade;

means for advancing an item of food with core intact towards the support member and into slicing engagement with the slicing member such that longitudinal axes of the food item and support member are aligned with one another; and means cooperable with the outer periphery of the support member for rotating the support member while the item of food is advanced into slicing engagement with the support member.

10. A cutting assembly for a food processing apparatus including:

a helical disk-like support member of substantially uniform pitch, the support member having a front surface towards which a food item is to be advanced and a slicing blade at a substantially radially extending edge thereof, the radially extending edge being substantially flush with the support member, the support member having an outer periphery;

a plurality of scoring blades mounted on said front surface extending substantially perpendicularly away therefrom for scoring the food item before the item is sliced by the slicing blade;

a mounting structure for supportively engaging the outer periphery of the support member; and means cooperable with the mounting structure for rotating the mounting structure and support member.

11. The cutting assembly of claim 10 wherein the mounting structure includes a holder having thread means for engaging the outer periphery of the support member so as to allow the support member to be threadably received by and removed from the holder through rotation of the support member relative to the holder.

12. A cutting assembly for a food processing apparatus comprising:

a disk-like cutting element having an outer periphery defining a first thread means to facilitate mounting of the cutting element;

a plurality of scoring blades extending substantially perpendicularly from the cutting element;

a mounting member for supporting the cutting element;

the mounting member having a portion thereof defining second thread means for cooperatively engaging and threadably receiving the outer periphery of the cutting element, the cutting element being mountable through rotation of the cutting element relative to the mounting member; and means for mounting the mounting member in the food processing apparatus such that the mounting member and cutting element are capable of rotation about a common axis of rotation;

the cutting element having a substantially radially extending slicing edge.

13. The assembly of claim 12 in which the cutting element is helicoidal.

14. A cutting assembly for use in slicing food items into helical strips, the cutting assembly comprising:

a helicoidal cutting element having a substantially radially extending slicing edge and an outer periphery defining a first thread means to facilitate mounting of the cutting element;

a plurality of scoring blades extending substantially perpendicularly from the cutting element; and a mounting member having second thread means for removably mounting the cutting element by threadably receiving the outer periphery of the cutting element;

the mounting member having an inner bore wall, the second thread means including a helical groove formed in the bore wall and having a pitch corresponding to the outer periphery of the helicoidal cutting element.

15. A food processing apparatus for slicing food items into helical strips, the apparatus comprising:

a cutting assembly including a helical disk-like cutting element and a plurality of scoring blades extending substantially perpendicularly from the cutting element, the cutting element having a substantially radially extending slicing edge and an outer periphery;

mounting means for removably mounting the cutting element by engaging the outer periphery;

a fixedly mounted housing to support the mounting means while permitting the mounting means and cutting element to rotate; and feeding means to automatically advance the food items one at a time to the cutting element.

16. The apparatus of claim 15 further including drive means cooperable with the mounting means for rotating the mounting means and cutting element.

17. An apparatus for slicing food items into helical strips comprising:

a helical disk-like cutting element having an outer periphery and a substantially radially extending knife edge;

a potato impaling member extending from a center portion of the cutting element;

a plurality of scoring knives extending substantially perpendicularly from the cutting element and being located varying radial distances from the impaling member;

a holding member for supporting the outer periphery of the cutting element;

means cooperable with the holding member for rotating the holding member and cutting element; and means for advancing the food items in a continuous, singulated flow to the cutting element.

18. The apparatus of claim 17 wherein the holding member includes a threaded bore for threadably receiving the outer periphery of the cutting element.

19. An apparatus for slicing food items into helical strips comprising:

a central potato impaling member;

a helical cutting disk affixed to the central member and having an inner edge, an outer periphery, a front surface extending from the inner edge to the outer periphery, a radially extending leading edge capable of slicing potatoes and the like, and a radially extending trailing edge, the inner edge abutting the central member;

a plurality of scoring blades extending substantially perpendicularly from the front surface of the cutting disk and being spaced varying radial distances from the central member;

a holding member for removably mounting the cutting disk by supportively engaging the outer periphery of the cutting disk;

a drive arrangement cooperable with the holding member for rotating the cutting disk by rotating the holding member to which the cutting disk is mounted;

a housing for holding the holding member and cutting disk in place while permitting the holding member and cutting disk to rotate relative to the housing;

a feed system for automatically feeding potatoes and the like one at a time to the cutting disk for slicing into helical strips.

20. The apparatus of claim 19 wherein the holding member includes a threaded bore adapted to receive and support the outer periphery of the cutting disk.

21. A food processing apparatus comprising:

a helicoidal disk-like cutter element adapted to slice food items into helical strips through unidirectional rotation, and having a longitudinal axis, a front surface and an outer periphery, the cutter element having a substantially radially extending leading slicing edge and a trailing edge, the slicing edge being substantially flush with the cutter element;

a plurality of scoring blades mounted on the front surface and extending substantially perpendicularly away therefrom for concentrically scoring the food item before the item is sliced by the slicing edge;

a mounting member for supportively engaging the cutter element, the mounting member including thread means for threadably receiving the outer periphery of the cutter element so as to permit the cutter element to be attached to and detached from the mounting member by threading the cutter element into and out of the thread means;

a feed means for advancing an item of food towards the cutter element, the feed means including a conveyor on which the food item is carried, the feed means further including at least one pair of rotatably driven feed rollers having means thereon for engaging the food item and biasing means for urging the feed rollers toward each other while permitting relative movement therebetween.

* * * * *